US011215044B2

(12) United States Patent
Warner et al.

(10) Patent No.: US 11,215,044 B2
(45) Date of Patent: Jan. 4, 2022

(54) ADAPTIVE NOISE REDUCTION FOR EVENT MONITORING DURING HYDRAULIC FRACTURING OPERATIONS

(71) Applicant: Cold Bore Technology Inc., Calgary (CA)

(72) Inventors: William Dean Warner, Maple Ridge (CA); Matthew Johan Zieleman, Langley (CA)

(73) Assignee: Cold Bore Technology Inc., Calgary (CA)

( * ) Notice: Subject to any disclaimer, the term of this patent is extended or adjusted under 35 U.S.C. 154(b) by 53 days.

(21) Appl. No.: 16/489,685

(22) PCT Filed: Mar. 2, 2018

(86) PCT No.: PCT/CA2018/050253
§ 371 (c)(1),
(2) Date: Aug. 28, 2019

(87) PCT Pub. No.: WO2018/157260
PCT Pub. Date: Sep. 7, 2018

(65) Prior Publication Data

US 2020/0240250 A1 Jul. 30, 2020

Related U.S. Application Data

(60) Provisional application No. 62/466,834, filed on Mar. 3, 2017.

(30) Foreign Application Priority Data

Aug. 23, 2017 (CA) ..... CA 2977316

(51) Int. Cl.
*E21B 43/26* (2006.01)
*E21B 34/14* (2006.01)
(Continued)

(52) U.S. Cl.
CPC ..... *E21B 43/26* (2013.01); *E21B 34/14* (2013.01); *E21B 33/12* (2013.01); *E21B 34/063* (2013.01); *E21B 47/14* (2013.01); *E21B 2200/06* (2020.05)

(58) Field of Classification Search
CPC ..... E21B 43/26; E21B 34/14; E21B 34/063; E21B 2200/06; E21B 33/12; E21B 47/14
(Continued)

(56) References Cited

U.S. PATENT DOCUMENTS 4,590,593 A * 5/1986 Rodney ..... E21B 47/18 367/43
4,715,222 A 12/1987 Huang
(Continued)

FOREIGN PATENT DOCUMENTS

CA 2209947 7/1997
CA 2603536 12/2012
(Continued)

OTHER PUBLICATIONS

S. Sinanovic, "Limits of Acoustic Waveguide Communication", PhD Thesis, Rice University, Apr. 2006, UMI #3216782.

*Primary Examiner* — Matthew R Buck
*Assistant Examiner* — Patrick F Lambe
(74) *Attorney, Agent, or Firm* — Todd A. Rattray; Oyen Wiggs Green & Mutala LLP

(57) ABSTRACT

A system detects an acoustic-wave-producing downhole event associated with a pipe at an uphole location in the presence of surface noise. The system comprises: a first plurality of acoustic sensors located a first axial position along the pipe and oriented symmetrically about the pipe axis; and a second plurality of acoustic sensors located a second axial position along the pipe and oriented symmetrically about the pipe axis, the second axial position spaced
(Continued)

apart from the first axial position. A processor is connected to receive the signals from the first and second pluralities of sensors and configured to process the sensor signals to thereby produce an output signal. The processor is configured to adjust the digital processing, based on the sensor signals, to minimize a contribution of the surface noise to the output signal.

23 Claims, 9 Drawing Sheets

(51) Int. Cl.
*E21B 33/12* (2006.01)
*E21B 34/06* (2006.01)
*E21B 47/14* (2006.01)

(58) Field of Classification Search
USPC ..... 166/308.1
See application file for complete search history.

(56) References Cited

U.S. PATENT DOCUMENTS 5,010,527 A * 4/1991 Mahrer ..... E21B 43/26 166/254.2
5,831,934 A * 11/1998 Gill ..... G01V 1/52 367/25
5,969,638 A 10/1999 Chin
6,084,826 A * 7/2000 Leggett, III ..... E21B 44/00 367/82
6,246,962 B1 6/2001 Schultz et al.
7,508,734 B2 * 3/2009 Fink ..... E21B 47/16 367/43
7,817,062 B1 10/2010 Li et al.
8,242,928 B2 8/2012 Prammer
9,598,950 B2 3/2017 Frosell
2006/0227005 A1 * 10/2006 Fincher ..... H04L 25/0228 340/855.4
2007/0132606 A1 6/2007 Reckmann et al.
2007/0192031 A1 * 8/2007 Li ..... E21B 47/18 702/6
2007/0215345 A1 * 9/2007 Lafferty ..... E21B 43/26 166/250.1
2007/0263448 A1 11/2007 Wong et al.
2008/0259728 A1 10/2008 Kyllingstad
2010/0171639 A1 7/2010 Clark
2010/0172210 A1 7/2010 Clark
2014/0017092 A1 1/2014 Brackel
2016/0108725 A1 4/2016 Benson
2016/0209537 A1 7/2016 Chmiel et al.

FOREIGN PATENT DOCUMENTS

GB 2438050 6/2009
GB 2472535 4/2011
WO 2006001704 1/2006
WO 2006110391 10/2006
WO 2007095103 8/2007
WO 2007095153 8/2007
WO 2012027633 3/2012
WO 2014011968 1/2014

* cited by examiner

ADAPTIVE NOISE REDUCTION FOR EVENT MONITORING DURING HYDRAULIC FRACTURING OPERATIONS

CROSS REFERENCE TO RELATED PATENT APPLICATIONS

This international application claims the benefit of the priority of U.S. Application 62/466,834, filed, 3 Mar. 2017, and CA Application 2,977,316, filed, 23 Aug. 2017, both of which are hereby incorporated herein by reference in their entirety.

FIELD

This application relates to communications in hydraulic fracturing (fracking) operations and/or in other operations involving downhole pipes, drill strings and/or the like. Particular embodiments provide event monitoring and/or detection of downhole events at a surface portion of the pipe in the face of considerable surface noise.

BACKGROUND

Hydraulic Fracturing (more commonly known as, and hereinafter referred to as, "fracking") is a well-stimulation technique in the oil & gas industry in which underground rock formations are fractured by pressurized liquid or gas/liquid formulation. Fracking involves high-pressure injection of "fracking fluid" through a pipe located in a wellbore to create cracks/fissures in the deep-rock formations, which are then held open with proppant (e.g., sand) which is added to the fracking fluid, through which natural gas and/or other petroleum resources may flow more freely.

Fracking is typically most effective when it is performed in multiple stages along the length of a wellbore. One common technique for implementing this staged operation, referred to as a "plug & perf" technique, involves inserting a steel tube/pipe into the wellbore spanning from the toe (deepest point of the wellbore) to the surface. The plug & perf pipe, typically made of steel, commonly incorporates a series of expanding rings lining the outside of the pipe. After insertion into the wellbore, these rings, often referred to as "packers", expand and seal against the surface of the wellbore (e.g. against the deep-rock formation). Explosive charges are inserted into the bore of the pipe and then detonated deep within the pipe at locations (along the pipe axis) between two consecutive packers. The exploding charge penetrates through the steel pipe creating pathways from the bore of the pipe into the surrounding wellbore. Fracking fluid is then pumped into the pipe at high pressure. The high pressure fracking fluid travels down the pipe, from a bore of the pipe to an exterior of the pipe through the pathways created by the explosive charge, and into the region of the wellbore localized by the bounding packers. The pressure of the fracking fluid causes cracks/fissures to occur in the formation around the wellbore. A proppant, such as sand or ceramic material for example, is typically added to the fracking fluid. The proppant travels down the pipe with the fracking fluid and, under pressure, is embedded into the cracks/fissures in the formation, such that the cracks/fissures remain open when pressure is removed.

After fracking a section of the wellbore in this manner, an expanding plug is typically inserted into the pipe to seal off the section of the well that was just fracked. Then, another explosive charge is inserted into the bore of the pipe and detonated in a new location of the pipe to create pathways through the pipe and to the wellbore at a new region of the pipe. This part of the wellbore and the corresponding formation is then fracked in a manner similar to the deeper section described above. This fracking process is repeated over a plurality of repetitions—e.g. until a desired length of the wellbore residing in the formation of interest has been f racked. After fracking the desired length of the wellbore, the expanding plugs that were inserted into the pipe are typically drilled out or otherwise removed from the bore of the pipe to create fluid flow pathways from all sections of the wellbore to the surface.

The plug & perf technique has a fundamental limitation of having to repeatedly insert and retract equipment from the surface to the downhole region of localized fracking, a distance that can exceed 10 km. This insertion and retraction of equipment is time consuming and expensive. It can also be dangerous when the explosive charges do not fully detonate and are unknowingly brought to the surface in an undetonated state.

An alternative to the plug & perf technique is referred to as a "ball-activated" or "ball and sleeve" fracking technique. In a ball-activated technique, functional sleeves are included inline in the steel fracking pipe at locations, along the pipe axis, between adjacent pairs of packers. Each of these sleeves allow fracking fluid to flow through them (down the pipe bore) until a suitably designed ball is launched into the pipe bore from the surface and lodges in a receptor within a particular sleeve, thereby sealing off the flow of fracking fluid down the pipe bore beyond the particular sleeve. Under increasing pressure from the f racking fluid, a ball received in a particular sleeve typically shifts within the sleeve, revealing openings in the wall of the sleeve (referred to as fracking ports), thereby providing a pathway for the pressurized fracking fluid to flow from within the bore of the pipe into a localized region of the wellbore outside of the pipe bore and between a corresponding pair of packers.

In one common ball-activated system, each sleeve has a ball seat of different dimension (e.g. different diameter) such that sleeves located relatively close to the surface (at uphole locations) have relatively large diameter and sleeves located farthest from the surface (at downhole locations) have relatively small diameter. Uphole sleeves, with relatively large diameter seats, allow balls with smaller diameter to pass through unimpeded. This way, downhole zones (i.e. zones relatively far from the surface along the pipe axis) are fracked first and uphole zones (i.e. zones relatively close to the surface along the pipe axis) are fracked last.

In another common type of ball-activated system, each ball has the same diameter and sleeves are designed to let a specific number of balls pass through before preventing a ball from passing through and thus sealing flow of fracking fluid (down the pipe bore) to downhole locations beyond the sleeve.

In either type of ball-activated fracking system, there is a desire to know, at the surface, that a ball has successfully seated in a sleeve and/or that the sleeve has opened to reveal its fracking ports. Current ball-activated fracking systems attempt to detect the occurrence of these events by monitoring the pressure of the fracking fluid. When a ball seats or otherwise lodges in a corresponding sleeve, flow of fracking fluid beyond the sleeve is prevented and the pressure within the fracking fluid increases as due to the sudden stop of flow while pumping action continues. If the pressure builds beyond a corresponding threshold, the fracking sleeve shifts to reveal its fracking ports. The sleeve shift and opening of corresponding f racking ports causes a rapid reduction in the pressure within the fluid, which can sometimes be detected by suitable pressure monitoring.

The method of monitoring fracking fluid pressure to determine that ball seats and port shifts have occurred is error prone and there is a general desire for a more reliable techniques for detecting these and/or other downhole events.

Once the fracking ports to a localized fracking zone are confirmed to be open, fracking of the formation in and around the localized fracking zone can commence. It is also desirable to be able to identify when formation fractures occur (fracture events). Typically, there is desire to cause a plurality of formation fractures in each localized zone. Using current pressure monitoring techniques, fracture events can frequently, but not reliably, be detected. There is a general desire for a more reliable and/or sensitive method for detecting formation fracture events. Accurate knowledge of formation fracture events allows personnel to decrease the time and resources expended to adequately f rack a localized formation region when that formation region is fracturing easily, and to increase time and resources expended if a formation region is not fracturing easily.

There is a general desire for reliably detecting acoustic-wave-producing downhole events (e.g. ball seat events, sleeve-shifting/port opening events, fracture formation events, launching of activation balls, plug & perf detonation events, undesired fracking pipe rupture events, fracture events in adjacent wells and/or the like).

BRIEF DESCRIPTION OF THE DRAWINGS

The accompanying drawings illustrate non-limiting example embodiments of the invention.

DETAILED DESCRIPTION

Figure 1:
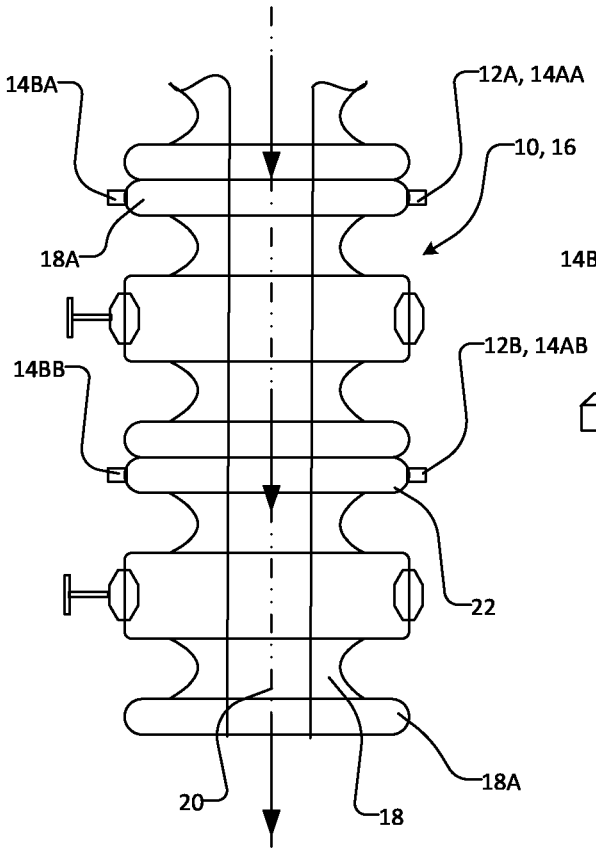
FIG. 1 is a schematic cross-sectional view of a sensor system disposed at (or above) the surface of a well head on a fracking pipe according to a particular embodiment.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Aspects of the invention described and/or claimed herein provide methods and systems for detecting acoustic-wave-producing downhole events (e.g. ball seat events, sleeve-shifting/port opening events, fracture formation events, launching of activation balls, plug & perf detonation events, undesired fracking pipe rupture events, fracture events in adjacent wells and/or the like). Such methods and systems may be more sensitive and/or more reliable than prior art techniques.

One aspect of the invention provides a system for detecting an acoustic-wave-producing downhole event associated with a pipe extending below a surface of the earth at an uphole location located above a downhole location of the acoustic-wave-producing downhole event in the presence of acoustic-wave-producing uphole activity (which may be referred to as uphole noise and/or surface noise). The system comprises: a pipe extending below the surface of the earth along a pipe axis; a first plurality of sensors located a first axial position along the pipe, the first plurality of sensors oriented symmetrically about the pipe axis at the first axial position, each of the first plurality of sensors generating a corresponding signal in response to acoustic waves in a vicinity thereof; a second plurality of sensors located a second axial position along the pipe, the second axial position spaced apart from the first axial position along the pipe axis, the second plurality of sensors oriented symmetrically about the pipe axis at the second axial position, each of the second plurality of sensors generating a corresponding signal in response to acoustic waves in a vicinity thereof; and a processor connected to receive the signals from the first and second pluralities of sensors and configured to digitally process the signals from the first and second pluralities of sensors to thereby produce an output signal. The processor is configured to adjust the digital processing, based on the signals from the first and second pluralities of sensors, to minimize a contribution of the acoustic-wave-producing uphole activity to the output signal, thereby permitting a contribution of the acoustic-wave-producing downhole event to be discernable from within the output signal.

Another aspect of the invention provides a method for detecting an acoustic-wave-producing downhole event associated with a pipe extending below a surface of the earth along a pipe axis at an uphole location located above a downhole location of the acoustic-wave-producing downhole event in the presence of acoustic-wave-producing-uphole activity. The method comprises: locating a first plurality of sensors at a first axial position along the pipe and orienting the first plurality of sensors symmetrically about the pipe axis at the first axial position, each of the first plurality of sensors generating a corresponding signal in response to acoustic waves in a vicinity thereof; locating a second plurality of sensors at a second axial position along the pipe, the second axial position spaced apart from the first axial position along the pipe axis, and orienting the second plurality of sensors symmetrically about the pipe axis at the second axial position, each of the second plurality of sensors generating a corresponding signal in response to acoustic waves in a vicinity thereof; digitally processing the signals from the first and second pluralities of sensors to produce an output signal; and adjusting the digital processing, based on the signals from the first and second pluralities of sensors, to minimize a contribution of the acoustic-wave-producing uphole activity to the output signal, thereby permitting a contribution of the acoustic-wave-producing downhole event to be discernable from within the output signal.

A fracking ball making contact with a ball seat in the "frack sleeve" of a ball-activated fracking system is an example of a downhole event which produces an acoustic wave (i.e. a vibratory mechanical pressure and/or displacement wave). Another example of a downhole event which produces an acoustic wave is when the frack sleeve opens to reveal its fracking ports. Yet another example of an acoustic-wave-producing downhole event is the fracturing of a formation around a frack pipe due to the intense pressure exerted by the f racking fluid. The acoustic energy from these and/or other downhole acoustic-wave-producing events propagates in all directions, including up the pipe axis of frack pipe, which can act as an acoustic propagation conduit. As the distance travelled by the propagating acoustic wave increases, the amplitude of the sound wave gets weaker and the acoustic wave becomes correspondingly harder to detect. At uphole locations of a fracking pipe at or near the surface, there are typically many mechanical pumps and other pieces of heavy vibrating equipment in close proximity to the wellhead producing their own acoustic waves and making it considerably more difficult to detect and/or identify downhole acoustic-wave-producing events of interest because of the presence of acoustic energy from this relatively strong acoustic-wave-producing uphole activity. For the purpose of this document, the aggregation of acoustic energy from acoustic-wave-producing uphole activity may be referred to as surface noise or, for more brevity, noise. This surface noise ought not to be confused with the concept of uncorrelated random noise, such as Additive White Gaussian Noise (AWGN).

The ability to detect and/or identify relatively weak downhole acoustic-wave-producing events in the presence of relatively strong surface noise may be implemented, in some embodiments, by the combination of specific arrangements of pluralities of acoustic sensors (i.e. sensors which have output signals correlated with acoustic waves in a vicinity thereof) located at suitable positions along and about the pipe axis and adaptive digital signal processing (DSP) noise reducing algorithms (implemented by suitably one or more configured processors), which process digitally sampled signals from the pluralities of sensors to generate a corresponding output signal. Such adaptive DSP noise reducing algorithms may be adapted or adjusted, based on the signals from the pluralities of sensors, to minimize a contribution of the surface noise to the output signal, thereby permitting a contribution of the acoustic-wave-producing downhole event to be more readily discernable from within the output signal (as compared to without adjusting the DSP noise reducing algorithms).

FIG. 1 depicts a sensor system 10 of an exemplary embodiment comprising a plurality (e.g two in the illustrated embodiment) of sensor groups 12A, 12B, each sensor group 12A, 12B comprising a corresponding plurality (e.g two in the illustrated embodiment) of sensors 14AA, 14BA, 14AB, 14BB suitably located on the wellhead 16 of a fracking pipe 18 having a pipe axis 20. Sensors 14AA, 14BA, 14AB, 14BB may be collectively and/or individually referred to herein as sensors 14. Groups or pluralities of sensors 12A, 12B may be collectively or individually referred to herein as groups or pluralities of sensors 12. Sensors 14 of the FIG. 1 embodiment are mounted on the flanges of valves 18A, which are common at the wellhead of a fracking pipe 18. In this disclosure and any accompanying aspects or claims, unless the context dictates otherwise, components of a pipe (e.g. pipe 18) which are acoustically connected to the pipe (such as the valves 18A and/or the like) should be understood to be included within the meaning of the term pipe. Each sensor 14 within a group 12 may be located at the same axial position (i.e. effective location along pipe axis 20). For example, groups 12A, 12B of sensors 14 may be spaced apart from each other along pipe axis 20, but the corresponding sensors 14AA, 14BA and 14AB, 14BB within each sensor group 12A, 12B may be located at the same axial position along pipe axis 20. Sensors 14 within a sensor group 12 may be distributed evenly or symmetrically around pipe axis 20. For example, sensors 14AA, 14BA in sensor group 12A are distributed at 180° relative to one another about pipe axis 20 and sensors 14AB, 14BB in sensor group 12B are distributed at 180° relative to one another about pipe axis 20. In the illustrated embodiment of FIG. 1, sensors 14 are mounted on valve flanges 22 of pipe 18, although this is not necessary.

Figure 2A:
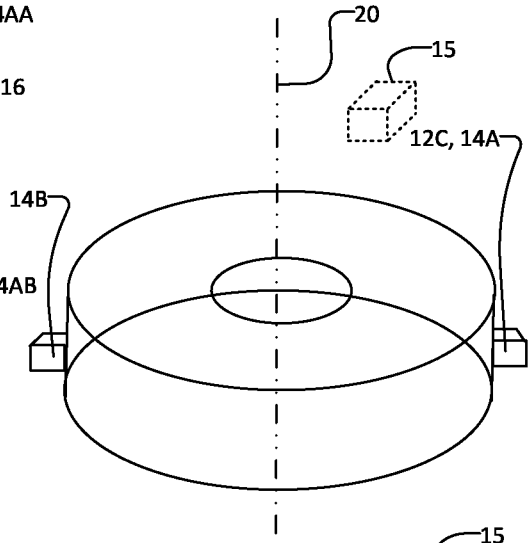
FIGS. 2A, 2B and 2C respectively depict relative mounting positions about the pipe axis for groups of sensors comprising two, three and four sensors per group according to a particular embodiment.
Figure 2B:
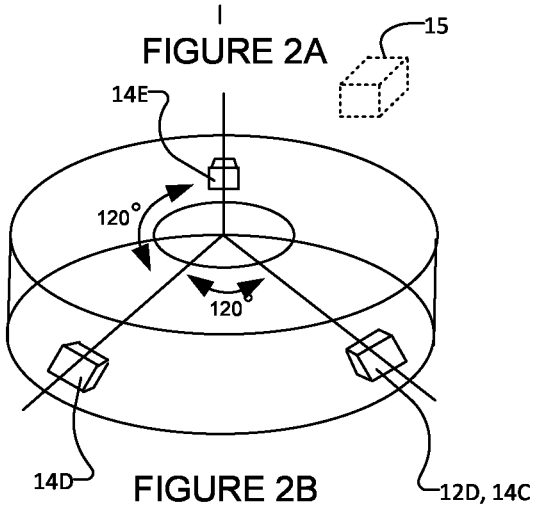
Figure 2C:
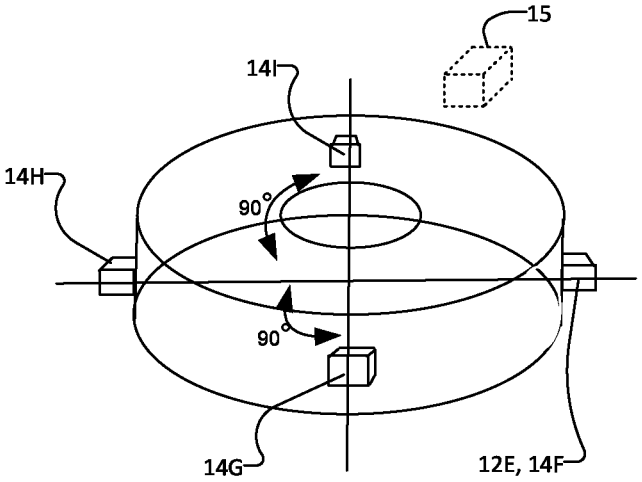

FIGS. 2A, 2B and 2C respectively depict relative mounting positions about pipe axis 20 for groups 12 of sensors 14 comprising two, three and four sensors 14 per group 12 according to a particular embodiment. FIG. 2A depicts a sensor group 12C comprising a pair of sensors 14A, 14B located at the same axial location along pipe axis 20 and having 180° angular separation about pipe axis 20. FIG. 2B depicts a sensor group 12D comprising three sensors 14C, 14D, 14E located at the same axial location along pipe axis 20 and having 120° angular separation about pipe axis 20. FIG. 2C depicts a sensor group 12E comprising four sensors 14F, 14G, 14H, 14I located at the same axial location along pipe axis 20 and having 90° angular separation about pipe axis 20. In general, each sensor group may comprise a plurality of sensors located at the same axial location along pipe axis 20, where the plurality of sensors is symmetrically distributed about pipe axis 20. Perfectly precise sensor placement is not necessary, but precise placement leads to improved noise reduction.

As shown in FIG. 1, sensor system 10 comprises multiple (two or more) groups 12 of sensors 14, each sensor group 12 comprising a plurality of sensors 14 symmetrically distributed about pipe axis 20. As shown in FIG. 1, each group 12 of sensors 14 is placed at a different axial location along pipe axis 20 of fracking pipe 18. In some embodiments, different sensor groups 12 spaced apart from one another along pipe axis 20 may comprise the same number or different numbers of sensors 14.

Figure 3:
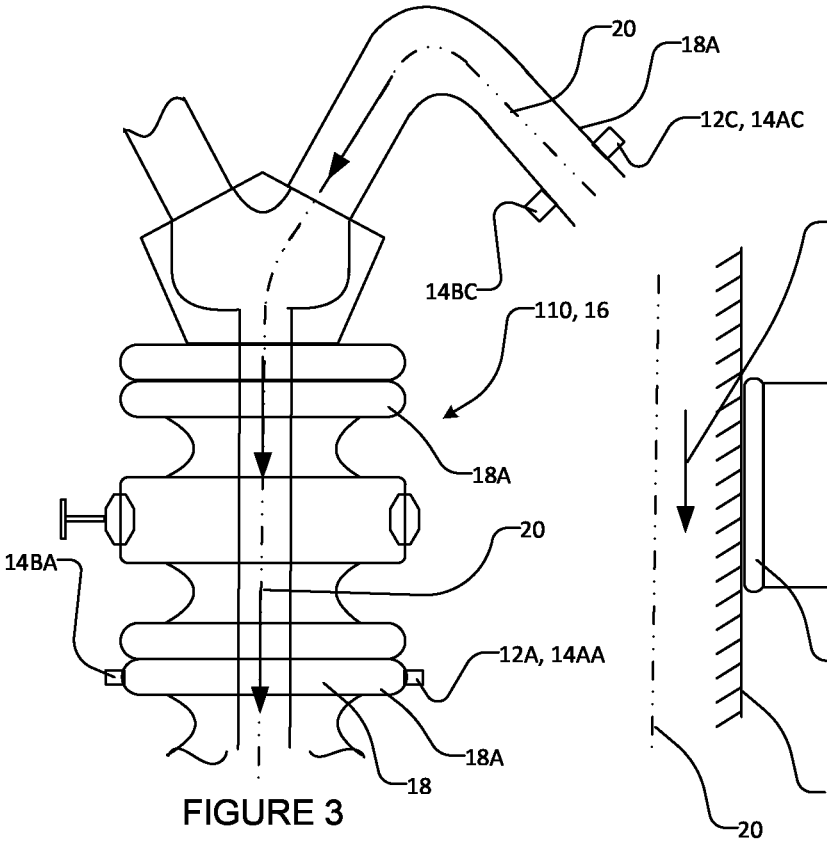
FIG. 3 is a schematic cross-sectional view of a sensor system mounted to a fracking pipe according to another embodiment.

FIG. 3 shows a sensor system 110 according to another embodiment. Sensor system 110 is deployed at or near the wellhead 16 of fracking pipe 18. Sensor system 110 is similar to sensor system 10 of FIG. 1, but differs because sensor system 110 comprises a first group 12A of sensors 14AA, 14BA directly mounted onto the wellhead, but a second group 12C of sensors 14AC, 14BC mounted on a sub-pipe 18A which is feeding pressurized fracking fluid to wellhead 16 and to main fracking pipe 18. Sensory system 110 of the FIG. 3 embodiment demonstrates that sensors 14 need not be mounted directly on the main fracking pipe 18 to perform effectively. As used herein, unless the context dictates otherwise, the term "pipe" should be understood to include sub-pipes or the like which feed fracking fluid into a main fracking pipe or other extensions of a main pipe in a drilling assembly. FIG. 3 also demonstrates that pipe axis 20 need not be linear. Pipe axis 20 of the FIG. 3 embodiment extends into sub-pipe 18A and may have bends, curvature and/or the like. As used herein, unless the context dictates otherwise, the term "pipe axis" should be understood to include the axis of a pipe, whether such pipe comprises a main fracking pipe, sub-pipes or the like which feed fracking fluid into a main fracking pipe or other extensions of a main pipe in a drilling assembly. Sensors 14AC, 14BC of second sensor group 12C may be located at the same axial location along pipe axis 20 and may be symmetrically located about pipe axis 20, as discussed above.

Sensors 14 are sensitive to acoustic waves (i.e. vibratory mechanical pressure and/or displacement waves). That is, sensors 14 generate corresponding signals in response to acoustic waves in a vicinity thereof. Various embodiments of the invention may comprise various types of acoustic wave sensors 14 which may be mounted in or on pipe 18 to generate corresponding electrical signals in response to acoustic waves in a vicinity thereof. In some exemplary embodiments, sensors 14 produce electrical signals dependent upon sensed acceleration, velocity, or position of pipe 18 in the vicinity of where each sensor 14 is mounted to pipe 18. Sensors 14 could additionally or alternatively be mounted within the bore of pipe 18 and produce electrical signals dependent upon the instantaneous pressure of the fracking fluid in the bore of pipe 18. In some embodiments, each sensor 14 may comprise one or more accelerometers.

In some embodiments, acceleration and velocity sensors 14 may be magnetically mounted to pipe 18. Sensors 14 may be physically mounted to or within a housing that incorporates a magnetic surface that provides a strong magnetic bond with pipe 18 (pipe 18 usually being fabricated from ferrous material(s)). In some embodiments, sensors 14 may be physically mounted to pipe 18 using threaded fasteners and/or other types of mechanical fasteners or attachment mechanisms. The attachment of pressure sensors to fracking pipes (such as pipe 18) is well known in the f racking industry and any such attachment techniques may be used for sensors 14.

Sensors 14 that are sensitive to motion, such as acceleration or velocity sensors, typically have a primary axis of sensitivity, although some are designed with multi-axis sensitivity. A multi-axis sensor may effectively be considered to be multiple separate single axis sensors integrated into a single unit. Single axis sensors 14 tend to be strongly sensitive to motion in the identified axis of operation and significantly less sensitive along axes orthogonal to the identified axis of operation.

Figure 4:
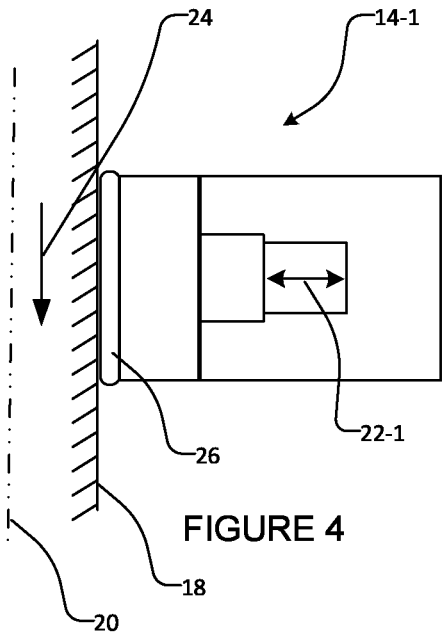
FIG. 4 illustrates an exemplary mounting of a sensor with its primary sensitivity axis oriented perpendicular to the pipe axis and the direction of fracking fluid flow within the pipe according to a particular embodiment.
Figure 5:
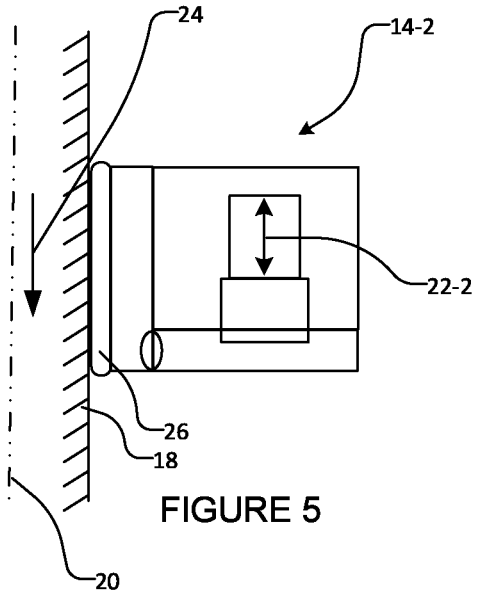
FIG. 5 illustrates an exemplary mounting of a sensor with its primary sensitivity axis oriented parallel to the pipe axis and the direction of fracking fluid flow within the pipe according to a particular embodiment.

For such directional motion sensors 14, various embodiments of the invention comprise sensors 14 having various different mounting orientations. FIG. 4 illustrates an exemplary mounting of a sensor 14-1 with its primary sensitivity axis 22-1 oriented perpendicular to pipe axis 20 and the direction 24 of flow of fracking fluid within pipe 18 according to a particular embodiment. FIG. 5 illustrates an exemplary mounting of a sensor 14-2 with its primary axis 22-2 of sensitivity oriented parallel to pipe axis 20 and the direction 24 of flow of fracking fluid within pipe 18 according to a particular embodiment. In both of the embodiments of FIGS. 4 and 5, magnetic components 26-1, 26-2 are used to mount the housings 28-1, 28-2 to ferrous pipe 18.

The selection of perpendicular sensor mount (i.e. alignment of sensors with their primary sensitivity axes 22 perpendicular to pipe bore 20, as shown, for example in FIG. 4) versus parallel sensor mount (i.e. alignment of sensors with their primary sensitivity axes 22 parallel to pipe bore 20, as shown, for example in FIG. 5) presents a trade-off between conflicting issues. With a parallel sensor mount, sensors 14 will be less sensitive to mechanical vibration of pipe 18 in directions orthogonal to pipe axis 20, but may also be less sensitive to vibrations of interest in pipe 18 and/or in the high-pressure f racking fluid in the bore of pipe 18. Conversely, a perpendicular sensor mount may be more sensitive to both undesirable vibrations of pipe 18 in directions orthogonal to pipe axis 20 and vibrations of interest in pipe 18 and/or the fracking fluid in the bore of pipe 18. As discussed above, sensors 14 could be mounted to pipe 18 using other techniques. In some embodiments, sensors 14 could be mounted to pipe 18 with their sensitivity axes at angles that are other than perpendicular to and parallel to pipe axis 20.

In some embodiments, sensors 14 within a particular sensor group 12 are oriented in a consistent manner (e.g. with their respective sensitivity axes 22 arranged with perpendicular mounts or with their respective sensitivity axes 22 arranged with parallel mounts). This is not necessary, however. In some embodiments, two or more sensor groups 12 are provided with sensors 14 that have consistent orientation—that is, two or more sensor groups 12 are provided with sensors arranged with parallel mounts or two or more sensor groups 12 are provided with sensors arranged with perpendicular mounts. This is not necessary, however.

Figure 6:
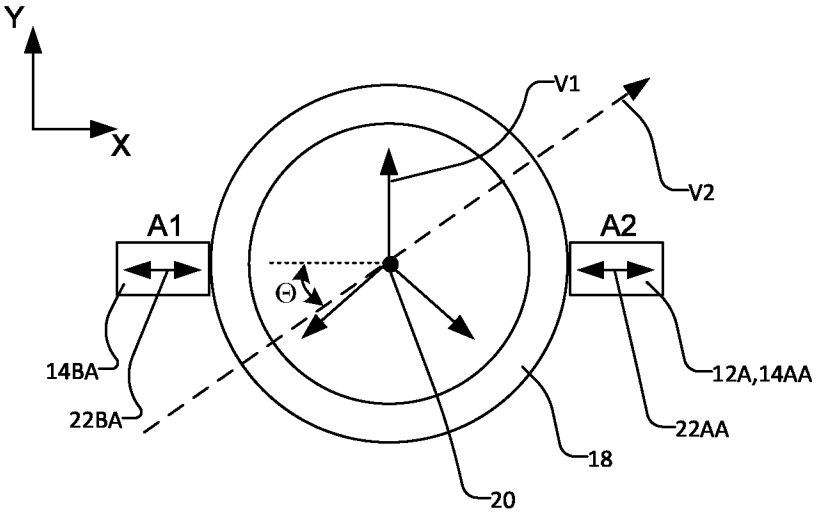
FIG. 6 is a schematic cross-sectional view in a plane perpendicular to the pipe axis showing a sensor group according to a particular embodiment.

Sensors 14 which are mounted and arranged as discussed herein advantageously facilitate differentiation between acoustic waves (e.g. vibrations) that are symmetric about pipe axis 20 and acoustic waves (e.g. vibrations) that have some particular directionality with respect to pipe axis 20. This is schematically illustrated in the cross-sectional view of FIG. 6 which is taken in a plane that is generally orthogonal to pipe axis 20 (shown in FIG. 6 as an X-Y plane). The illustrated view of FIG. 6 shows a plurality of sensors 14AA, 14BA in a sensor group 12A symmetrically distributed about pipe axis 20 and located at the same axial position along axis 20 of pipe 18. In the illustrated embodiment, the plurality of sensors 14 in group 12A comprises a pair of sensors, but sensor group 12A could comprise a large number of sensors 14. Because of the symmetrical orientation of sensors 14, the primary sensitivity axes 22AA, 22BA of sensors 14AA, 14BA are aligned with one another and their respective directions of positive sensitivity can be opposite to one another.

Consider now, an example of vibration of pipe 18 in the X-Y plane. Pressure waves in the fracking fluid will tend to induce vibrations radiating outwards from pipe axis 20. If we label the radial symmetric vibration as V1 and any non-symmetric vibration in the X-Y plane as V2, then we can write the resulting sensor signals as: $S_{14AA=}V1+\mathrm{Cos}(\theta)V2$; and $S_{14BA}=V1-\mathrm{Cos}(\theta)V2$. Summing these two equations yields: SA1+SA2=2V1. The effect of the non-symmetric X-Y plane vibration V2 is eliminated, or, in practice significantly reduced. This elimination or reduction of asymmetrical vibrations extends to other symmetric multi-sensor arrangements, where there are more than two sensors equally distributed around the circumference.

In most circumstances, particularly while an active fracking operation is underway, fracking wellhead (e.g. the portion of pipe 18 above the ground) is considered a hazardous and explosive environment. Consequently, in some embodiments, intrinsic safety (IS) barriers may be deployed to isolate 14 sensors from signal processing circuitry 100 (described in more detail below), which may be used to process signals 102 received from sensors 14 and to generate therefrom a reduced-noise downhole event signal 104. Preferably, the IS barriers do not unduly distort signals 102 from sensors 14.

Figure 7:
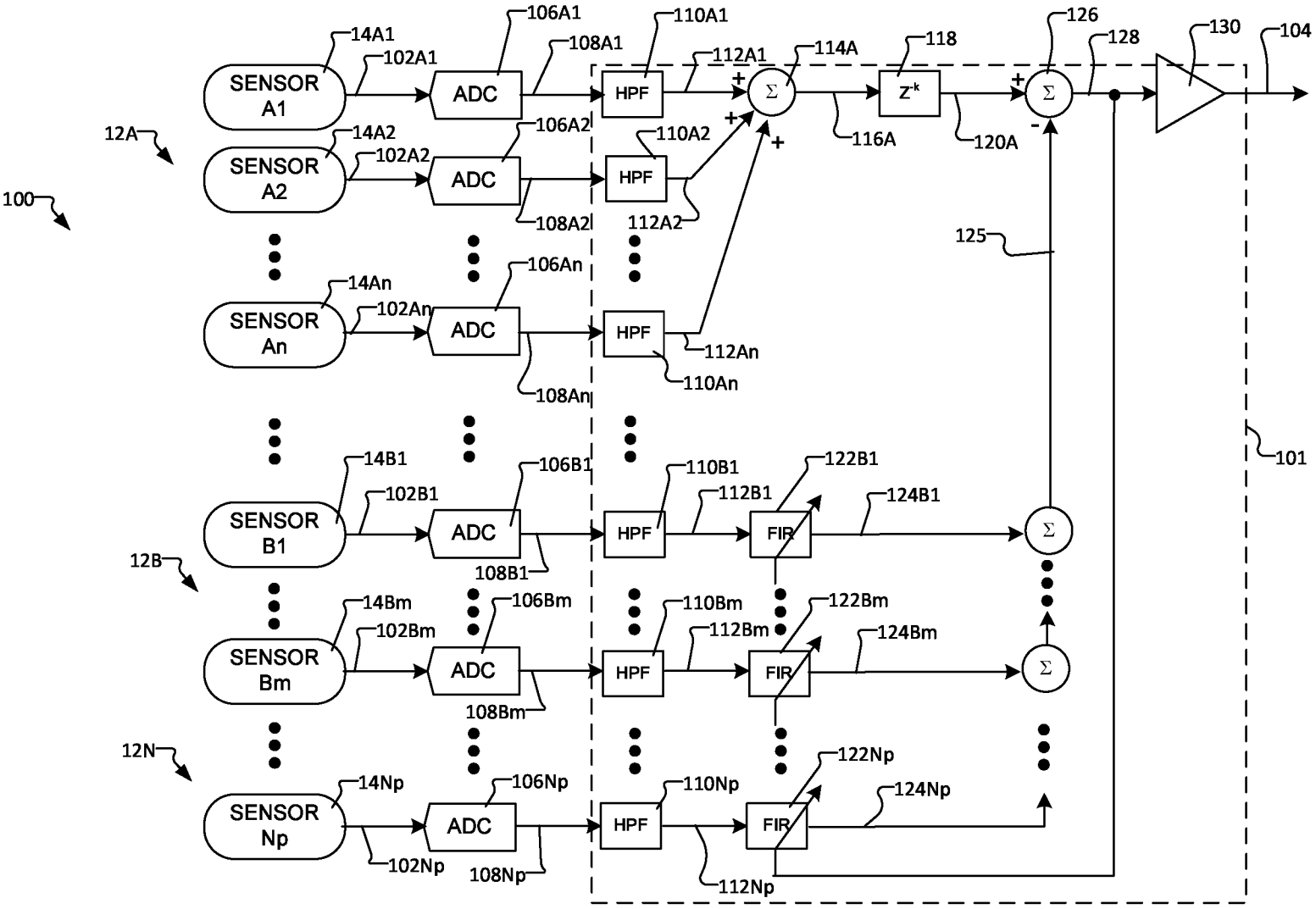
FIGS. 7, 7A schematically illustrate signal processing circuits according to particular embodiments, which receive sensor signals from sensors and generate therefrom reduced-noise downhole event signals.

FIG. 7 schematically illustrates a signal processing circuit 100 according to a particular embodiment, which receives sensor signals 102 from sensors 14 and generates therefrom a reduced-noise downhole event signal 104. Reduced-noise downhole event signal 104 may be at or near zero except for a short period after startup and when a downhole event is detected. A number of the components of signal processing circuit 100 may be implemented by a suitably configured processor 101 (shown in dashed lines in FIG. 7). Signal processing circuit 100 of the illustrated embodiment, comprises N groups of sensors 12A, 12B . . . 12N (collectively, and individually sensor groups 12). Sensor group 12A is shown to have n individual sensors 14A1, 14A2 . . . 14An; sensor group 12B is shown to have m individual sensors 14B1 . . . 14Bm; and sensor group 12N is depicted to have p individual sensors 14N1 . . . 14Np, when n, m, p>=2. Sensors 14 within each group 12 and groups of sensors 12 may have the characteristics discussed elsewhere herein. Each sensor 14A1, 14A2 . . . 14An, 14B1 . . . 14Bm . . . 14Np (collectively and individually, sensors 14) generates a corresponding sensor signal 102A1, 102A2 . . . 102An, 102B1 . . . 102Bm . . . 102Np (collectively and individually, sensor signals 102). While not expressly shown in FIG. 7, signal processing circuit 100 may comprise a variety of non-illustrated signal conditioning/processing circuitry components known in the art that are not germane to the understanding of the FIG. 7 embodiment. By way of non-limiting example, such circuitry components may comprise intrinsic barriers (discussed briefly above), amplifiers, filters and/or the like.

Sensor signals 102 are received by corresponding analog to digital converters (ADCs) 106A1, 106A2 . . . 106An, 106B1 . . . 106Bm . . . 106Np (collectively and individually, ADCs 106). ADCs 106 share a common sampling clock (which may be provided by processor 101 or otherwise), so that analog sensor signals 102 are digitized with a common clock to generate corresponding digital signals 108A1, 108A2 . . . 108An, 108B1 . . . 108Bm . . . 108Np (collectively and individually, digital signals or digital data streams 108). A currently preferred sampling frequency is 48 kHz, but a wide range of suitable sampling frequencies may be used in various embodiments. Lower sampling frequencies tend to ease the associated computational expense of signal processing, but may potentially sacrifice useful signal content. In the illustrated embodiment, ADCs 106 are provided separately from processor 101. This is not necessary. In some embodiments, processor 101 may be suitably configured to implement ADCs 106.

Optionally, digital data streams 108 are high pass filtered by high pass filters (HPFs) 110A1, 110A2 . . . 110An, 110B1 . . . 110Bm . . . 110Np (collectively and individually, HPFs 110). Such high pass filtering may remove low frequency components which may be of relatively low interest, but which may be quite strong. The resulting high pass filtered digital data streams 112A1, 112A2 . . . 112An from all of the sensors 14 in first sensor group 12A are summed together (summing junction 114A). Together with the sensor mounting orientations and configurations described herein, the aggregated first sensor group 12A output data stream 116A from summing junction 114A will tend to emphasize the signal component that is common to the sensors 14 of first sensor group 12A, while suppressing the signal component that is differential. For example uniform radial expansion of the pipe outward from pipe axis 20 will result in components of sensor signals 102 which are common to each sensor 14, while asymmetrical mechanical vibration of pipe in the X-Y plane will result in components of sensor signals 102 that are different for each sensor 14 and which will tend to sum to zero when the first data streams 112A1, 112A2, 112An are combined. The summed data stream 116A from all sensors 14 in first sensor group 12A are then delayed (at delay block 118) to generate a resultant delayed aggregate signal 120A which accounts for expected filtering delay of the sensor signals 102B . . . 102N in sensor groups 12B to 12N. The delay selected for delay block 118 may account for expected delays associated with Finite Impulse Response (FIR) filtering of the sensor signals 102B . . . 102N in sensor groups 12B to 12N, as discussed further below.

High pass filtered digital data streams 112B1 . . . 112Bm . . . 112Np from sensor groups 12B to 12N are independently filtered using adaptive FIR filters 122B1 . . . 122Bm . . . 122Np (collectively and individually, FIR filters 122, described further below) and their corresponding filtered output signals 124B1 . . . 124Bm . . . 124Np (collectively and individually, FIR output signals 124, described further below) are summed to create aggregate FIR filtered signal 125. Aggregate FIR filtered signal 125 is then subtracted from the delayed aggregate signal 120A from first sensor group 12A (at summing junction 126) to output a residual signal 128. Each of FIR filters 122 may be independently adapted (e.g. using a least mean squares (LMS) adaptation algorithm or any other suitable adaptation algorithm) based on residual signal 128, with the common objective of the independent adaptation being to drive residual signal 128 to zero or to otherwise minimize residual signal 128. While FIR filters 122 are adapted together by processor 101, each FIR filter 122 may be adapted independently in the sense that the adaptation of FIR filters 122 may be performed by processor 101 without knowledge/interaction as between FIR filters 122.

Downhole events of interest (e.g. ball seating events, sleeve activation events, fracking events and/or the like) tend to be infrequent short-duration discrete events, whereas undesired surface sounds tend to be regular and continuous (long-duration) in nature. Continuous adaptation of (i.e. updating filter coefficients of) the plurality of FIR filters 122 will generate an aggregate FIR filtered signal 125 which, when subtracted from delayed aggregate signal 120A from first sensor group 12A (at summing junction 126), will successfully reduce the level of residual signal 128 to at or near zero. When a downhole event occurs, the acoustic energy waveform follows a different propagation path to the collection of sensors 14 relative to the path followed by acoustic energy from surface equipment and is detectable as a non-zero event in residual signal 128. In theory, it is possible to completely cancel (or in practice to effectively minimize) undesired acoustic energy from surface activity, without severely impacting acoustic energy waveforms originating from downhole events, which are desirable to detect.

Optionally, residual signal 128 (which is effectively a noise-reduced downhole event signal 128) can be amplified (e.g. numerically and/or the like) by amplifier 130 to generate noise-reduced downhole event signal 104. Often, downhole event signals are extremely weak. With appropriate amplification by amplifier 130, a user can physically listen to the noise-reduced downhole event signal 104 by applying the amplified signal (optionally after conversion to an analog format) to an appropriate audio port (not shown). In some embodiments, suitable circuits, processes and/or methods may use noise-reduced downhole event signal 104

(and/or an analog version thereof) to automatically detect the occurrence of downhole events and/or to discriminate between different types of (e.g. to classify) downhole events.

Adaptation of filters 122 represents selection of suitable filter parameters (e.g. filter coefficients and/or the like, often referred to as "filter taps") of FIR filters 122 to achieve an adaption objective. Such an adaptation objective may involve adjusting the filter parameters of FIR filters 122 to minimize a suitably configured objective function. As discussed above, the adaptation of FIR filters 122 corresponding to sensor groups 12B . . . 12N can be adapted using a Least Mean Squares (LMS) algorithm, with the objective being to minimize residual signal 128. The LMS adaptation method provides an adapted approximation to the optimal Minimum Mean Squared Error (MMSE) solution. The LMS adaptation method is well known in the art of adaptive filtering via digital signal processing and is not explained in further detail here. While LMS represents the currently preferred adaptation mechanism, some embodiments may additionally or alternatively use other adaptation algorithms. There are a variety of filter adaptation algorithms known to those skilled in the art of adaptive filtering via digital signal processing. Non-limiting examples of such adaptation techniques include Normalized LMS, Root Least Squares (RLS), and/or the like.

Downhole events represent anomalies to the more regular surface noise. An overly aggressive adaptation technique may tend to suppress the acoustic waveforms caused by downhole events (in an effort to minimize residual signal 128). Accordingly, some embodiments make use of a relatively low level of adaptation aggressiveness, so that the adaptation will suitably suppress surface noise at start-up, but will also permit the recognition of a downhole event within residual signal 128. For example, in some embodiments, an aggressiveness parameter (e.g. p) having a normalized range of (0,1) or some other appropriate range, can be set to have a normalized value of $\mu<0.1$. In some embodiments, this aggressiveness parameter is set to $\mu<0.05$. In some embodiments, this aggressiveness parameter is set to $\mu<0.025$. The cost of a relatively low level of adaptation aggressiveness is a longer initial adaptation time—i.e. more iterations to suppress surface noise at startup.

A typical fracking pipe 18 and, in particular, a fracking wellhead (the portion of pipe 18 above the surface) comprises a number of different components with varying shapes. These varying components and their varying shape yields a relatively complex acoustic reflection environment. There is a desire that the adaptive noise reduction signal processing circuit 100 be robust to such variation. Those knowledgeable in the art will recognize that this implies the need for many FIR filter taps in FIR filters 122. Conceptually, time-domain adaptation and application of FIR filters 122 with many taps will provide the desired result (minimizing residual signal 128), but, from a practical perspective, providing such a large number of FIR filter taps in the time domain is inconvenient and computationally expensive.

Figure 8:
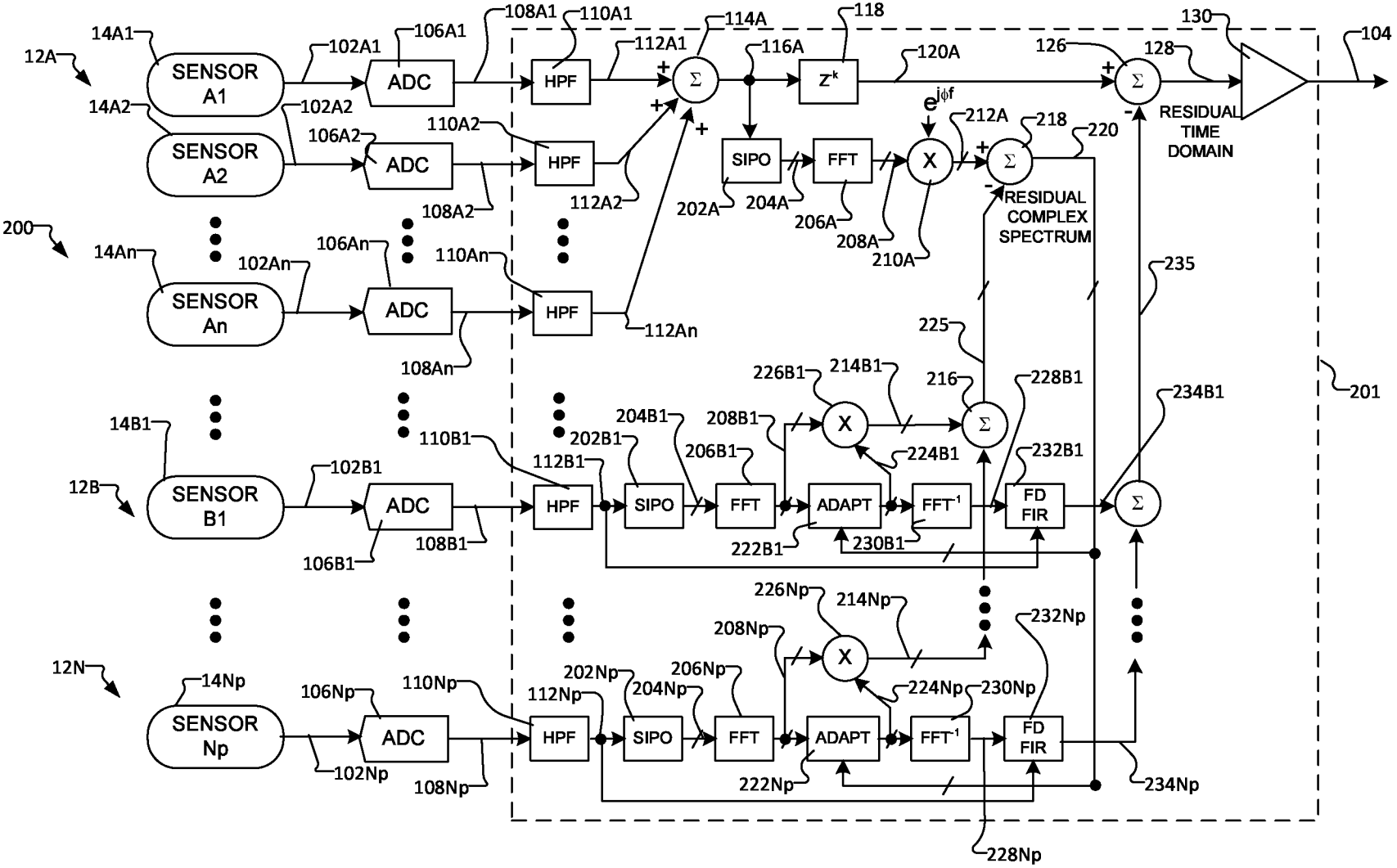
FIGS. 8, 8A show adaptive noise reduction signal processing circuits according to particular implementations of the more general architecture of signal processing circuits shown in FIGS. 7, 7A.

FIG. 8 shows an adaptive noise reduction signal processing circuit 200 according to a particular implementation of the FIG. 7 signal processing circuit 100. In signal processing circuit 200 of FIG. 8, the time domain architecture of signal processing circuit 100 (FIG. 7) has been converted to frequency domain. The time domain adaptation of the "many-tap" FIR filters 122 of circuit 100 (FIG. 7) has been converted into the parallel adaptation of many single-tap filters in circuit 200 (FIG. 8).

A number of the components of signal processing circuit 200 may be implemented by a suitably configured processor 201 (shown in dashed lines in FIG. 8). Signal processing circuit 200 of the FIG. 8 embodiment may be similar in many respects to signal processing circuit 100 of FIG. 7 embodiment. In particular, like signal processing circuit 100, signal processing circuit 200 may receive sensor signals 102 from sensors 14 and generate therefrom a reduced-noise downhole event signal 104. Reduced-noise downhole event signal 104 may be at or near zero except for a short period after startup and when a downhole event is detected. Further, sensor 14, sensor signals 102, ADCs 106, digital data streams 108, optional high pass filters 110, high pass filtered digital data streams 112, summing junction 114A, aggregated sensor group 12A, data stream 116A and delayed aggregated sensor group 12A data stream 120A of circuit 200 may be substantially similar to those of circuit 100 described elsewhere herein. Circuit 200 differs from circuit 100 in the adaptation and filtering of the remaining sensor signals 102B1 . . . 102Bn . . . 102Np prior to summing with delayed aggregated sensor group 12A data stream 120A.

In the FIG. 8 embodiment, for aggregated sensor group 12A data stream 116A and the other high pass filtered data streams 112B1 . . . 112Bn . . . 112Np, each serial data stream is segmented into contiguous blocks of K samples 204A, 204B1 . . . 204Np by Serial-In-Parallel-Out (SIPO) blocks 202A, 202B1 . . . 202Np (collectively and individually SIPOs 202). Then, for each set of K samples 204A, 204B1 . . . 204Np, a K-point Fast Fourier Transform (FFT) is computed at FFT blocks 206A, 206B1 . . . 206Np (collectively and individually FFTs 206), resulting in frequency domain data 208A, 208B1 . . . 208Np (collectively and individually, frequency domain data 208). Frequency domain data 208A resulting from aggregated sensor group 12A data stream 116A is modified by a frequency dependent phase vector $e^{j\Phi t}$ (at block 210A) that mimics the time delay introduced by block 118, resulting in an aggregate sensor group A spectral signal 212A.

The frequency domain data 208B1 . . . 208Np from each individual sensor 14 of the FIG. 8 embodiment then goes through an adaptive filtering process (explained in more detail below) resulting in adaptively processed frequency domain sensor streams 214B1 . . . 214Np (collectively and individually, adaptively processed frequency domain sensor streams 214). These adaptively processed frequency domain sensor streams 214 are then summed at summing junctions 216 to provide aggregate adaptively filtered frequency domain signal 225. Adaptively filter frequency domain signal 225 is then subtracted from aggregate sensor group A spectral signal 212A at summing junction 218. The output 220 of summing junction 218 represents the residual complex spectrum 220 and is provided to the adaptation processes for the frequency domain data 208B1 . . . 208Np from each of the sensors 14 in sensor groups 12B to 12N.

The adaptation cores 222B1 . . . 222Np (collectively and individually, adaptive cores 222) are substantially similar for each of the frequency domain data 208B1 . . . 208Np from each of the sensors 14 in sensor groups 12B to 12N. Spectral information for the corresponding current K-sample blocks of data (corresponding frequency domain data 208) and current residual complex spectrum 220 are passed to adaptation cores 222. Each adaptation core 222 then outputs an adapted spectral modification vector 224B1 . . . 224Np (collectively and individually, adapted spectral modification vector 224) that is applied to the spectral information for the current K-sample block (frequency domain data 208) at multiplication junction 226B1 . . . 226Np (collectively and individually, multiplication junction 226), resulting in the adaptively processed frequency domain sensor streams 214 discussed above. Additional detail of adaptation cores 222 according to a particular embodiment is discussed further below in connection with FIG. 9.

Adapted spectral modification vectors 224 are converted back into time domain impulse responses 228B1 . . . 228Np (collectively and individually, time domain impulse responses 228) by inverse FFT blocks 230B1 . . . 230Np (collectively and individually inverse FFTs 230). The resulting time domain impulse responses 228 and either data streams 108 or, optionally, high pass filtered data streams 112 may be passed to frequency domain FIR filters 232B1 . . . 232Np (collectively and individually FIR filters 232). Each FIR filter 232 receives two time domain input signals: a time domain impulse response 228 of its particular filter that is being adapted; and either a corresponding data stream 108 or a corresponding high pass filtered data stream 112. FIR filters 232 convert these time domain inputs to the frequency domain, filter the resultant signals in the frequency domain, and output time domain FIR output signals 234B1 . . . 234N (collectively and individually, time domain FIR output signals 234). FIR filters 232 may use information from previously filtered data as part of the filtering process, which can preserve continuity as between blocks of data. The FIR output signal 234 from each frequency domain FIR filter 232 is the portion of the corresponding sensor's data that may be used to cancel delayed aggregate signal 120A from first sensor group 12A. More particularly, time domain FIR output signals 234 from each sensor are summed to produce aggregate time domain FIR signal 235, which is subtracted from delayed aggregate signal 120A for first sensor group 12A (at summing junction 126) to produce time domain residual signal 128.

Time domain residual signal 128, amplifier 130 and reduced-noise downhole event signal 104 may be similar to and have characteristics similar to those discussed above in connection with FIG. 7. Those knowledgeable in the art will appreciate that there are alternative methods of applying adapted spectral modification vectors 224 to sensor data (e.g. to sensor data 102). It is not mandatory that adapted spectral modification vectors 224 be converted back to the time domain.

Figure 9:
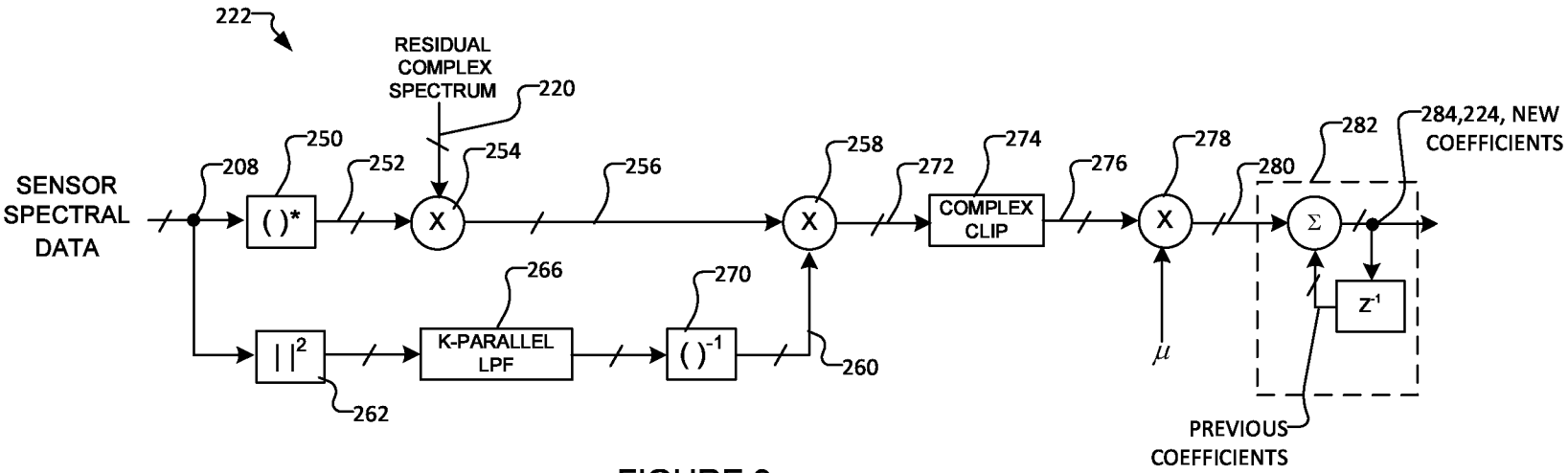
FIG. 9 is a schematic block diagram providing more detail of an adaption core according to a particular embodiment.

FIG. 9 is a schematic block diagram providing more detail of an adaption core 222 according to a particular embodiment. As discussed above, adaptation core 222 comprises a pair of inputs including the frequency domain data 208 for a K-sample block of data for a corresponding sensor 14 and residual complex spectrum 220. Frequency domain data 208 for the current K-sample block of sensor data (from FFT 206 (FIG. 8)) is complex conjugated at block 250 and the complex conjugated signal 252 is multiplied by the residual complex spectrum 220 at multiplication block 254, resulting in signal 256. This resulting signal 256 is scaled (at multiplication block 258) by a reciprocal of an average magnitude-square signal 260 that represents a reciprocal of an average (over successive K-sample FFT blocks 208) magnitude-square for each of the K frequency bins. In the illustrated embodiment, average magnitude-square signal 260 is computed over a plurality of consecutive FFT blocks (i.e. a plurality of consecutive K-sample blocks of frequency domain data) 208 using a low pass filter (LPF) 266. LPF 266 is a K-parallel LPF, which functions independently on each of the K bins of frequency domain data 208. Block 270 represents as reciprocal function which takes the reciprocal of the output from LPF 266 for each of the K frequency bins.

The output of the scaling at multiplication block 258 is a K-sample block 272 of scaled complex-conjugate data 272. A particular frequency bin of scaled complex-conjugate data 272 may have unusually large values in some circumstances. For example, the power of a particular frequency bin of scaled complex-conjugate data 272 may be unusually high when a downhole event occurs or the power of a particular frequency bin of scaled complex-conjugate data 272 may be unusually high when the signal power of the corresponding bin of sensor spectral data 108 is really low (i.e. such that the block 270 inversion and block 258 scaling result in a high value for scaled complex-conjugate data 272. In each of these cases, it can be desirable for adaptation core 222 not to respond to the unusually large values of scaled complex-conjugate data 272—e.g. minimizing (or reducing) the impact of downhole events on the adaptation permits other downhole events to be more easily discerned and minimizing (or reducing) the impact of bins of low average power sensor spectral data 108 can minimize (or reduce) the introduction and amplification of undesirable noise created by the block 270 reciprocal operation. Accordingly, in some embodiments, the scaled complex-conjugate data 272 is clipped at complex clip block 274 to preserve it's phase, but to limit its magnitude to some suitable threshold (e.g. unity). The output data 276 from complex clip block 274 may be further scaled (at multiplication block 278) by a configurable (e.g. user configurable) adaptation parameter p, which may be used to control the rate of adaptation. In some embodiments, the value of adaptation parameter p may have the ranges discussed above. The output 280 of multiplication block 278 is then applied to an integrating function at block 282. The output 284 of the block 282 integrating function is the adapted spectral modification vector 224 (FIG. 8) that is used to suppress unwanted surface noise. Those knowledgeable in the art will recognize that with the exception of complex clip function 274, this implementation is consistent with the Least Mean Square adaptation algorithm.

Figure 10:
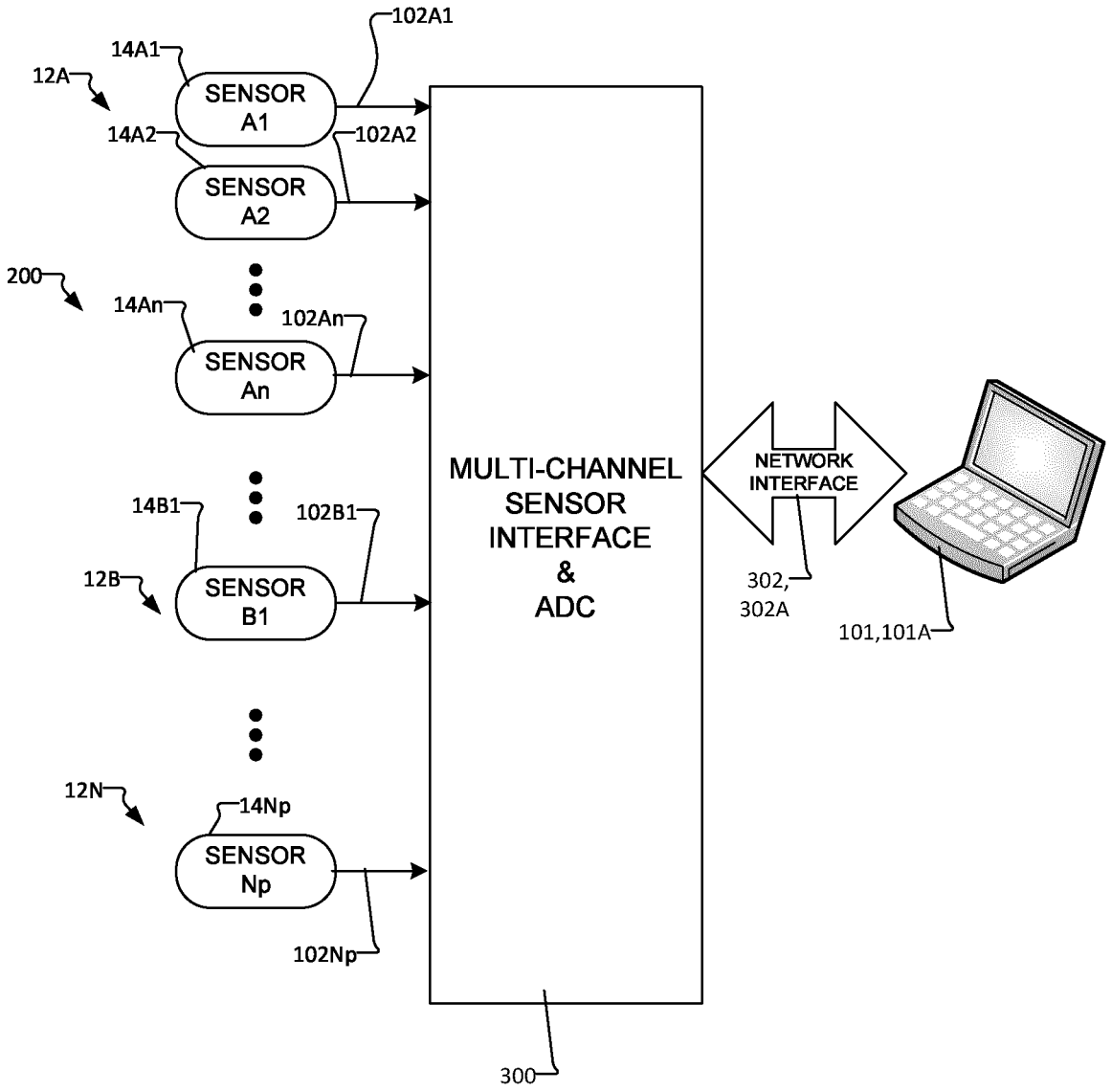
FIG. 10 shows an exemplary hardware implementation of the signal processing circuits of FIGS. 7 and 8 according to a particular embodiment.

Those skilled in the art will recognize that signal processing circuit 200 in the illustrated embodiment of FIGS. 9 and 10 represents one particular embodiment of the algorithmic architecture of signal processing circuit 100 shown in FIG. 7. There are numerous variations that could be implemented within the algorithmic structure of the FIG. 7 signal processing circuit 100. Such variations may differ from the example implementation shown in FIGS. 8 and 9. For example, the aggregate signal of the first sensor group 12A could be converted into frequency domain, modified by some frequency response vector and then this modified aggregate signal could be used to drive adaptation. In such a variation, the frequency domain FIR filters used on each individual sensor signal from sensor groups 12B to 12N can be further optimized. The conversion back to time domain can be deferred until after the spectral content from each sensor in sensor groups 12B to 12N is subtracted from the aggregated spectral content of the first sensor group 12A. This variation could exhibit a decrease in processing power as the number of total sensors 14 increases.

FIG. 10 illustrates a particular hardware implementation of signal processing circuit 100 (FIG. 7) and signal processing circuit 200 (FIG. 8) according to an example embodiment. Signals 102 from multiple sensors 14 are interfaced to an interface device 300 that incorporates circuitry to support the sensors 14 of choice, and then digitizes all sensor signals 102 using a common sample clock. The digital data from interface device 300 may then be provided to a suitable processor 101 via a suitable data transfer connection 302. In the illustrated embodiment, processor 101 is embodied in a laptop 101A or other similar computational device and data transfer connection 302 comprises a network interface 302A, such as an Ethernet connection or the like. Those skilled in the art will recognize that a variety of options exist for processor 101 and data transfer connection 302.

In another embodiment, sensory system 10 includes an electromagnetic (EM) noise sensor 15 for detecting electromagnetic energy and/or other forms of electrical noise (referred to herein as EM noise, for brevity) present at, and/or proximate to, the wellhead of fracking pipe 18. The presence of EM noise may distort output signals of sensors 14 making it more difficult to detect and/or identify downhole acoustic-wave-producing events of interest. In such embodiment, detected EM noise by EM noise sensor 15 may be subtracted from signals corresponding to sensors 14 reducing, if not completely eliminating, EM noise distortion present in the output signal.

In some embodiments, EM noise sensor 15 may be implemented by the same type of sensor as sensors 14 (e.g. acoustic sensors 14) described herein. EM noise sensor 15 is sensitive to electromagnetic energy and/or other forms of electrical noise. That is, EM noise sensor 15 generates a corresponding electrical signal in response to electromagnetic energy and/or other forms of electrical noise in a vicinity thereof. EM noise sensor 15 may, for example, comprise various types of sensors sensitive to electromagnetic energy commonly known in the art. EM noise sensor 15 may be installed proximate to a section of pipe 18 on which sensors 14 are mounted as illustrated by the dashed lines in FIGS. 2A to 2C. EM noise sensor 15 may be located in a vicinity of the other sensors 14, but may be spaced apart from pipe 18 to minimize the susceptibility of EM noise sensor to acoustic waves present on the pipe. The combination of signals corresponding to pluralities of sensors 14, an EM noise signal corresponding to EM noise sensor 15 and adaptive digital signal processing (DSP) noise reducing algorithms (as described herein) may be used to generate a EM noise reduced output signal.

More specifically, the adaptive DSP noise reducing algorithms described elsewhere herein (e.g. in FIGS. 7 and 8) may be adjusted to process a digitally sampled EM noise signal output from EM noise sensor 15 (e.g. based on the signals from the pluralities of sensors 14 and EM noise sensor 15), to minimize a contribution of EM noise to the output signal, thereby permitting a contribution of the acoustic-wave-producing downhole event to be more readily discernable from within the output signal (as compared to the DSP noise reducing techniques of FIGS. 7 and 8, which do not account for EM noise).

Figure 7A:
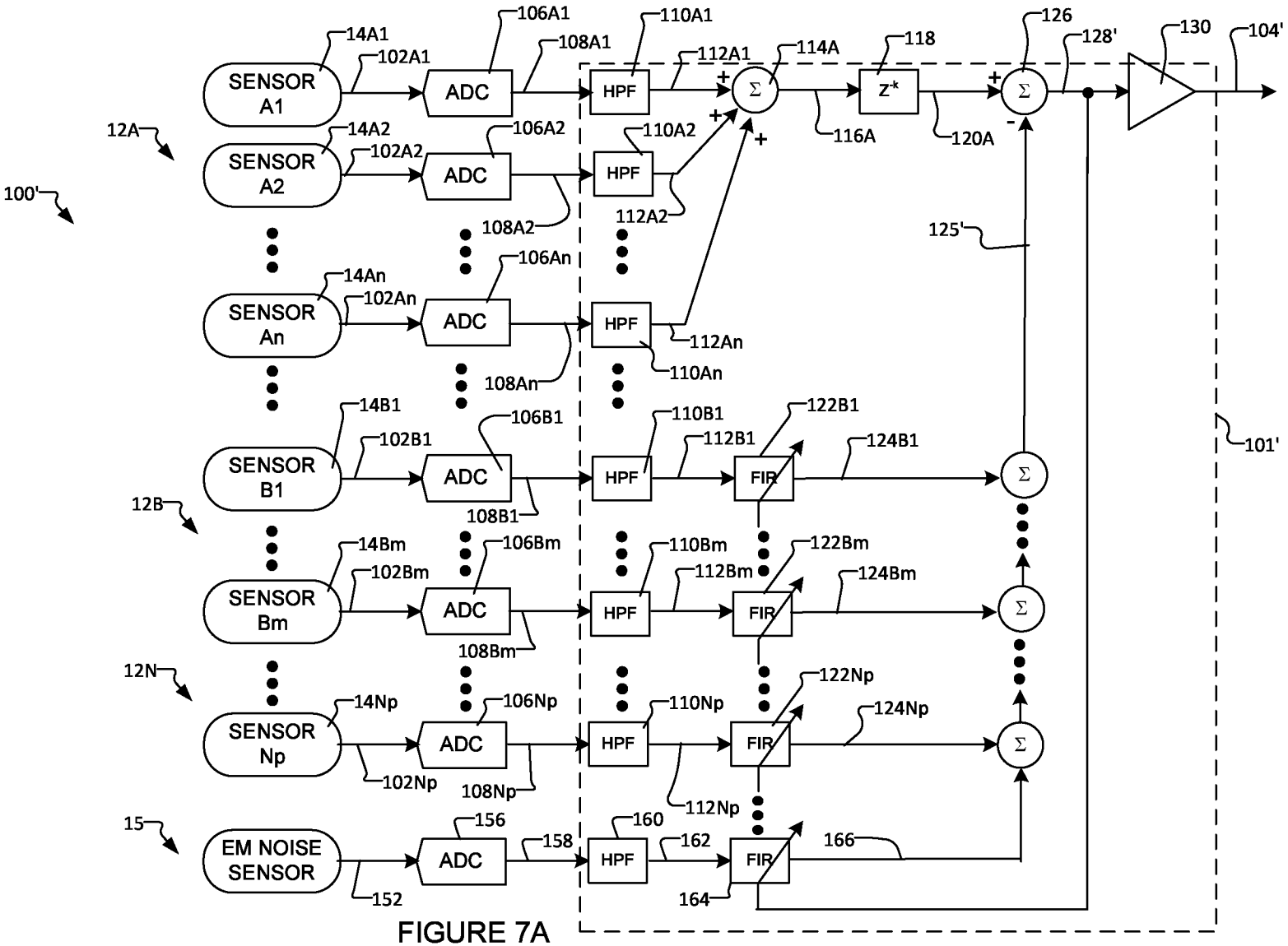

For example, FIG. 7A schematically illustrates a signal processing circuit 100' according to one EM noise reducing embodiment, which receives sensor signals 102 from sensors 14 and EM noise signal 152 from EM noise sensor 15 and generates therefrom a reduced acoustic and EM noise downhole event signal 104'. Except as described herein, circuit 100' may be similar to circuit 100 (FIG. 7) described elsewhere herein including that a number of the components of signal processing circuit 100' may be implemented by a suitably configured processor 101' (shown in dashed lines in FIG. 7A). Circuit 100' differs from circuit 100 by the inclusion of EM noise signal 152 from EM noise sensor 15 into circuit 100'.

EM noise sensor 15 generates a corresponding EM noise signal 152. EM noise signal 152 is received by analog to digital converter (ADC) 156 and converted, by ADC 156 into EM noise data stream 158. Optionally, digital EM noise data stream 158 is high pass filtered by high pass filter (HPF) 160. High pass filtered digital EM noise data stream 162 is filtered using adaptive FIR filter 164 and its corresponding filtered output signal 166 is summed with FIR output signals 124 to create aggregate filtered signal 125'. Aggregate FIR filtered signal 125' is then subtracted from the delayed aggregate signal 120A to output residual signal 128'. Each of FIR filters 122, 164 may be independently adapted based on residual signal 128' as disclosed elsewhere herein (e.g. in the description of FIG. 7). In some embodiments, residual signal 128' may be amplified by amplifier 130 to generate acoustic and EM noise-reduced downhole event signal 104'. ADC 156, optional HPF 160 and FIR filter 164 may be substantially the same as and operate in a manner substantially similar to ADCs 106, optional HPFs 110 and FIR filters 122 described elsewhere herein (e.g. in the description of FIG. 7). Similar to reduced-noise downhole event signal 104, acoustic and EM noise-reduced downhole event signal 104' may be at or near zero except for a short period after startup and when a downhole event is detected.

Figure 8A:
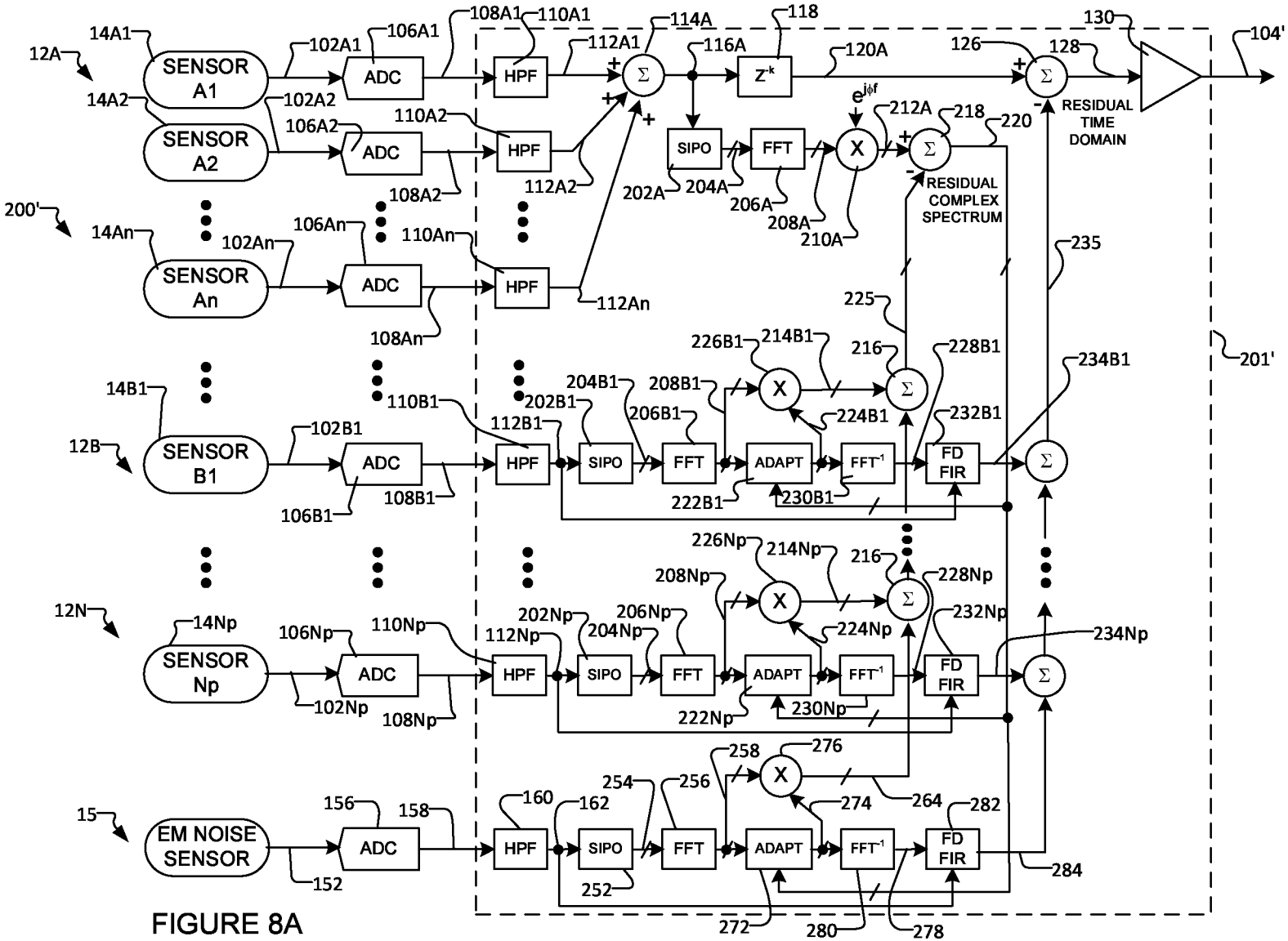

Optionally, the time domain architecture of signal processing circuit 100' (FIG. 7A) may be converted to the frequency domain. FIG. 8A illustrates an adaptive noise reduction signal processing circuit 200' according to a particular implementation of the FIG. 7A signal processing circuit 100' in the frequency domain. Except as described herein, circuit 200' may be similar to circuit 200 (FIG. 8) described elsewhere herein including that a number of the components of signal processing circuit 200' may be implemented by a suitably configured processor 201' (shown in dashed lines in FIG. 8A). Circuit 200' differs from circuit 200 in the integration of EM noise sensor 15 into circuit 200'.

In the FIG. 8A embodiment, EM noise signal 252 generated by EM noise sensor 15 is processed in a manner substantially similar to corresponding signals from sensor groups 12B1 . . . 12Bn . . . 12Np. In particular, like signals from sensor groups 12B1 . . . 12Bn . . . 12Np, high pass filtered EM noise data stream 162 is segmented into a contiguous block of K samples 254 by Serial-In-Parallel-Out (SIPO) block 252. Further, a K-point Fast Fourier Transform (FFT) is computed at FFT block 256, resulting in EM noise frequency domain data 258. EM noise frequency domain data 258 from EM sensor 15 then goes through an adaptive filtering process as described elsewhere herein (e.g. in the description of FIG. 8), resulting in adaptively processed EM noise frequency domain stream 264. Adaptation core 272 then outputs an adapted spectral modification vector 274 that is applied to the spectral information for the current K-sample block at multiplication junction 276. Adapted spectral modification vector 274 is converted back into EM noise time domain impulse response 278 by inverse FFT block 280. EM noise time domain impulse response 278 and either data stream 158 or optionally high pass filtered data stream 162 may be passed to frequency domain FIR filter 282. FIR output signal 284 is the portion of the EM noise sensor's data that may be used to cancel EM noise from delayed aggregate signal 120A. ADC 156, optional HPF 160, SIPO 252, FFT 256, adaption core 272, inverse FFT 280 and FIR filter 282 may be substantially the same as and operate in a manner substantially similar to ADCs 106, optional HPFs 110, SIPOs 202, FFTs 206, adaption cores 222, inverse FFTs 230 and FIR filters 232 described elsewhere herein.

Interpretation of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and, unless the context dictates otherwise, should not be interpreted narrowly.

Embodiments of the invention may be implemented using specifically designed hardware, configurable hardware, programmable data processors configured by the provision of software (which may optionally comprise "firmware") capable of executing on the data processors, special purpose computers or data processors that are specifically programmed, configured, or constructed to perform one or more steps in a method as explained in detail herein and/or combinations of two or more of these. Examples of specifically designed hardware are: logic circuits, application-specific integrated circuits ("ASICs"), large scale integrated circuits ("LSIs"), very large scale integrated circuits ("VLSIs"), and the like. Examples of configurable hardware are: one or more programmable logic devices such as programmable array logic ("PALs"), programmable logic arrays ("PLAs"), and field programmable gate arrays ("FPGAs")). Examples of programmable data processors are: microprocessors, digital signal processors ("DSPs"), embedded processors, graphics processors, math co-processors, general purpose computers, server computers, cloud computers, mainframe computers, computer workstations, and the like. For example, one or more data processors in a control circuit for a device may implement methods as described herein by executing software instructions in a program memory accessible to the processors.

Processing may be centralized or distributed. Where processing is distributed, information including software and/or data may be kept centrally or distributed. Such information may be exchanged between different functional units by way of a communications network, such as a Local Area Network (LAN), Wide Area Network (WAN), or the Internet, wired or wireless data links, electromagnetic signals, or other data communication channel.

For example, while processes or system blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

In addition, while elements are at times shown as being performed sequentially, they may instead be performed simultaneously or in different sequences. It is therefore intended that the following claims are interpreted to include all such variations as are within their intended scope.

Software and other modules may reside on servers, workstations, personal computers, tablet computers, image data encoders, image data decoders, PDAs, color-grading tools, video projectors, audio-visual receivers, displays (such as televisions), digital cinema projectors, media players, and other devices suitable for the purposes described herein. Those skilled in the relevant art will appreciate that aspects of the system can be practiced with other communications, data processing, or computer system configurations, including: Internet appliances, hand-held devices (including personal digital assistants (PDAs)), wearable computers, all manner of cellular or mobile phones, multi-processor systems, microprocessor-based or programmable consumer electronics (e.g., video projectors, audio-visual receivers, displays, such as televisions, and the like), set-top boxes, color-grading tools, network PCs, mini-computers, mainframe computers, and the like.

The invention may also be provided in the form of a program product. The program product may comprise any non-transitory medium which carries a set of computer-readable instructions which, when executed by a data processor, cause the data processor to execute a method of the invention. Program products according to the invention may be in any of a wide variety of forms. The program product may comprise, for example, non-transitory media such as magnetic data storage media including floppy diskettes, hard disk drives, optical data storage media including CD ROMs, DVDs, electronic data storage media including ROMs, flash RAM, EPROMs, hardwired or preprogrammed chips (e.g., EEPROM semiconductor chips), nanotechnology memory, or the like. The computer-readable signals on the program product may optionally be compressed or encrypted.

In some embodiments, the invention may be implemented in software. For greater clarity, "software" includes any instructions executed on a processor, and may include (but is not limited to) firmware, resident software, microcode, and the like. Both processing hardware and software may be centralized or distributed (or a combination thereof), in whole or in part, as known to those skilled in the art. For example, software and other modules may be accessible via local memory, via a network, via a browser or other application in a distributed computing context, or via other means suitable for the purposes described above.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. For example:

If velocity sensors 14 or acceleration sensors 14 are used to detect the downhole acoustic events, the resulting processed signal may actually represent the first derivative and second derivative, respectively, of the event sound. Those skilled in the art will recognize that it is a relatively simple matter to provide first order or second order integration if needed or desired.

Different sensor groups 12 can use different types of sensors. For example, sensor group 12A may use acceleration sensors, but sensor group 12B may use pressure sensors. This situation can easily be accommodated by applying appropriate derivative or integrating functions to one or more of the sensor group signal sets.

This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A system for detecting an acoustic-wave-producing downhole event associated with a pipe extending below a surface of the earth at an uphole location located above a downhole location of the acoustic-wave-producing downhole event in the presence of acoustic-wave-producing uphole activity, the system comprising:

a pipe extending below the surface of the earth along a pipe axis;

a first plurality of sensors located at a first axial position along the pipe, the first plurality of sensors oriented symmetrically about the pipe axis at the first axial position, each of the first plurality of sensors generating a corresponding signal in response to acoustic waves in a vicinity thereof;

a second plurality of sensors located at a second axial position along the pipe, the second axial position spaced apart from the first axial position along the pipe axis, the second plurality of sensors oriented symmetrically about the pipe axis at the second axial position, each of the second plurality of sensors generating a corresponding signal in response to acoustic waves in a vicinity thereof;

wherein the first and second axial positions of the first and second pluralities of sensors along the pipe are spaced upwardly apart along the pipe from the downhole location of the acoustic-wave-producing downhole event; and a processor connected to receive the signals from the first and second pluralities of sensors and configured to digitally process the signals from the first and second pluralities of sensors to thereby produce an output signal;

wherein the processor is configured to adjust the digital processing, based on the signals from the first and second pluralities of sensors, to minimize a contribution of the acoustic-wave-producing uphole activity to the output signal, thereby permitting a contribution of the acoustic-wave-producing downhole event to be discernable from within the output signal.

2. A system according to claim 1 wherein each of the first plurality of sensors comprises an accelerometer.

3. A system according to claim 2 wherein each of the first plurality of sensors is oriented with its primary axis of sensitivity oriented generally away from the pipe axis in a plane of the first axial position.

4. A system according to claim 2 wherein each of the first plurality of sensors is oriented with its primary axis of sensitivity oriented generally parallel to an orientation of the pipe axis at the first axial position.

5. A system according to claim 2 wherein each of the first plurality of sensors is magnetically coupled to an exterior surface of the pipe.

6. A system according to claim 1 wherein each of the first plurality of sensors comprises a velocity sensor.

7. A system according to claim 1 wherein each of the first plurality of sensors comprises a position sensor.

8. A system according to claim 1 wherein each of the first plurality of sensors comprises a fluid-pressure sensor.

9. A system according to claim 8 wherein each of the first plurality of sensors is located in a bore of the pipe.

10. A system according to claim 8 wherein each of the first plurality of sensors is rigidly mounted to a bore defining surface of the pipe.

11. A system according to claim 1 wherein the second plurality of sensors are of a same sensor type as the first plurality of sensors.

12. A system according to claim 1 wherein the second plurality of sensors are of a different sensor type as the first plurality of sensors.

13. A system according to claim 1 wherein symmetrical locations of the second plurality of sensors at the second axial position along the pipe correspond to the symmetrical locations of the first plurality of sensors at the first axial position along the pipe.

14. A system according to claim 1 wherein symmetrical locations of the second plurality of sensors at the second axial position along the pipe are different from the symmetrical locations of the first plurality of sensors at the first axial position along the pipe.

15. A system according to claim 1 wherein the processor is configured to minimize the contribution of the acoustic-wave-producing uphole activity to the output signal by performing an adaptive filtering process.

16. A system according to claim 15 wherein the adaptive filtering process comprises a LMS adaptive filtering process.

17. A system according to claim 15 wherein the processor is configured to perform the adaptive filtering process by, for each of the signals from each of the second plurality of sensors: adapting filter taps for one or more corresponding filters applied to the signal, so that after application of the one or more corresponding filters to each of the signals from each of the second plurality of sensors, the resulting filtered signals from the second plurality sensors sum to be at least approximately equal to a sum of the signals from each of the first plurality of sensors, in the absence of an acoustic-wave-producing downhole event.

18. A system according to claim 17 wherein the processor is configured to perform the adaptive filtering process by delaying the sum of the first plurality of sensors to account for delays associated with applying the one or more corresponding filters to each of the signals from each of the second plurality of sensors.

19. A system according to claim 18 wherein the processor is configured to perform the adaptive filtering process by subtracting the sum of the filtered signals from the second plurality of sensors from the delayed sum of the signals from the first plurality of sensors to obtain a residual signal.

20. A system according to claim 15 wherein the processor is configured to perform the adaptive filtering process in the frequency domain.

21. A system according to claim 20 wherein, as part of the adaptive filtering process, the processor is configured to perform a complex clipping operation in the frequency domain on a signal derived from a frequency domain complex residual spectrum and frequency domain spectral data corresponding to one of the sensors, the complex clipping operation preserving frequency domain phase of the signal while clipping frequency domain amplitude of the signal.

22. A method for detecting an acoustic-wave-producing downhole event associated with a pipe extending below a surface of the earth along a pipe axis at an uphole location located above a downhole location of the acoustic-wave-producing downhole event in the presence of acoustic-wave-producing-uphole activity, the method comprising:

locating a first plurality of sensors at a first axial position along the pipe, the first axial position spaced upwardly apart along the pipe from the downhole location of the acoustic-wave-producing downhole event, and orienting the first plurality of sensors symmetrically about the pipe axis at the first axial position, each of the first plurality of sensors generating a corresponding signal in response to acoustic waves in a vicinity thereof;

locating a second plurality of sensors at a second axial position along the pipe, the second axial position spaced apart from the first axial position along the pipe axis and spaced upwardly apart along the pipe from the downhole location of the acoustic-wave-producing downhole event, and orienting the second plurality of sensors symmetrically about the pipe axis at the second axial position, each of the second plurality of sensors generating a corresponding signal in response to acoustic waves in a vicinity thereof;

digitally processing the signals from the first and second pluralities of sensors to produce an output signal; and adjusting the digital processing, based on the signals from the first and second pluralities of sensors, to minimize a contribution of the acoustic-wave-producing uphole activity to the output signal, thereby permitting a contribution of the acoustic-wave-producing downhole event to be discernable from within the output signal.

23. A method according to claim 22 comprising:

locating an electromagnetic noise sensor proximate to the first or second pluralities of sensors, the electromagnetic noise sensor generating a corresponding electromagnetic noise signal in response to electromagnetic energy in a vicinity thereof;

wherein the processor is connected to receive the electromagnetic noise signal and configured to digitally process the electromagnetic noise signal to thereby subtract a filtered electromagnetic noise signal from the output signal; and wherein the processor is configured to adjust the digital processing, based at least in part on the electromagnetic noise signal, to minimize a contribution of the electromagnetic energy to the output signal.

* * * * *